United States Patent [19]

Horsewell et al.

[11] Patent Number: 4,660,579

[45] Date of Patent: Apr. 28, 1987

[54] TOBACCO SMOKE FILTERS

[75] Inventors: Henry G. Horsewell, Totton; Martin G. Duke; James W. Phelpstead, both of Southampton, all of England

[73] Assignee: British-American Tobacco Company Limited, London, England

[21] Appl. No.: 790,723

[22] Filed: Oct. 24, 1985

[30] Foreign Application Priority Data

Nov. 17, 1984 [GB] United Kingdom ..... 8429104

[51] Int. Cl.[4] ..... A24D 3/04

[52] U.S. Cl. ..... 131/339; 131/340

[58] Field of Search ..... 131/336, 339, 340, 338

[56] References Cited

FOREIGN PATENT DOCUMENTS 1377181 12/1974 United Kingdom ..... 131/339

2103065 2/1983 United Kingdom ..... 131/339

2105566 3/1983 United Kingdom ..... 131/339

*Primary Examiner*—V. Millin

*Attorney, Agent, or Firm*—Kane, Dalsimer, Kane, Sullivan and Kurucz

[57] ABSTRACT

Cigarette filters comprises a filter element, open for smoke flow at the mouth end, and smoke passage of flow impedance less than that of the filter element. The passage is closed at the downstream end so that smoke is constrained to pass into the element at the downstream end of the passage. The passage may be an annular cross-section duct or grooves at the periphery of the element or may be a bore within the element. The filters provide an increasing degree of filtration as smoking proceeds.

7 Claims, 8 Drawing Figures

TOBACCO SMOKE FILTERS

BACKGROUND OF THE INVENTION

1. Field of the Invention

This invention relates to tobacco smoke filters for use in smoking articles, cigarettes for example.

2. Brief Description of the Prior Art

When a conventional filter tipped cigarette is smoked, the delivery of particulate matter and nicotine in the mainstream smoke increases with each puff. The final puff can deliver two, or even three times more of these smoke components than is delivered in the initial puffs. Proposals have been made for providing filters in the use of which the smoke component delivery rises less steeply during the smoking of a cigarette. Thus, for example, in United Kingdom Patent Specification No. 1,428,018 there are disclosed filters comprising by-pass channels. In use of such a filter, during early puffs smoke passes along the by-pass channel and at the downstream end of the channel passes into a body of filtration material through an orifice which is formed in the otherwise smoke impervious wall of the channel. As smoking proceeds, the orifice becomes blocked by the accumulation of particulate material of the smoke. Eventually, the smoke can no longer pass through the orifice and passes instead through the full length of the body of filtration material. Thus during later puffs the smoke is subjected to a greater degree of filtration than is the case in the earlier puffs. However, the achievement of a desired delivery profile is dependent upon accurate dimensioning of the orifice. At the very high speeds at which filters are required to be produced a consistently accurate formation of a small orifice, as called for in filters according to United Kingdom Patent Specification No. 1,428,018, is very difficult to achieve.

It is an object of the present invention to provide a tobacco smoke filter which, while meeting the requirement for a gradually increasing degree of smoke filtration, is of simple construction and readily makable at speeds consistent with current filter production practice.

SUMMARY OF THE INVENTION

The present invention provides a tobacco smoke filter comprising a body of smoke filtration material a downstream end of which is open for smoke flow therethrough, and smoke flow passage means of smoke flow impedance less than that of said body, the downstream end of said passage means being at least substantially closed to smoke flow and said passage means being in smoke flow communication with said body at least at a region of said passage means extending from the downstream end thereof.

The body of smoke filtration material can take the form of a cylindrical filter element. Such cylindrical filter element is preferably enwrapped by a permeable plugwrap.

When the body of smoke filtration material takes the form of a cylindrical filter element, the smoke flow passage means can be provided in the form of a duct of annular cross-section or of a groove or grooves, which duct or groove(s) is bounded by the peripheral surface of the element and by wall means spaced radially outwardly from the element.

Provision may be made for ventilation air to pass through the wall means.

Instead of being located at the periphery of a cylindrical filter element providing the body of smoke filtration material, the smoke flow passage means can extend within and longitudinally of such an element. In such case, the peripheral surface of the element is preferably substantially impervious to smoke, whereby when smoke passes radially outwardly from the smoke passage means into the filtration material of the element, it is constrained to flow therealong to the downstream end of the eleent. However, provision may be made for ventilation air to pass through the peripheral surface of the element.

The smoke flow passage means may contain low pressure drop filter material.

BRIEF DESCRIPTION OF THE DRAWINGS

In order that the present invention may be readily understood and carried into effect, reference will now be made, by way of example, to the accompanying diagrammatic drawings, in which:

FIGS. 3 and 5 show, in axial section, cigarette filters each of which is different from that of FIG. 1, whereas

DETAILED DESCRIPTION OF THE INVENTION

Figure 1:
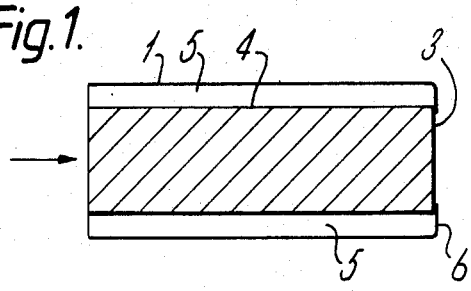
FIGS. 1 shows, in axial section, a cigarette filter.
Figure 2:
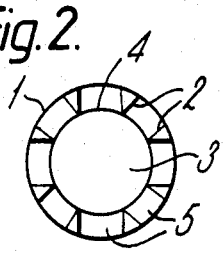
FIG. 2 shows an end view of the filter of FIG. 1 looking in the direction of the arrow.

The cigarette filter of FIGS. 1 and 2 comprises a tubular casing 1 which is provided with radially inwardly projecting ridges 2 which extend over the full length of the casing 1. The casing 1 may be formed, for example, of a rigid plastics material. It is a requirement of the material of the casing 1 that it should be smoke impervious. Disposed within the casing 1 and extending coextensively therewith is a cylindrical element 3 of tobacco smoke filtration material, as for example filamentary cellulose acetate or polypropylene, enwrapped in porous plugwrap 4. As is clearly shown in FIGS. 1 and 2, the diameter of the element 3 is less than that of the casing 1. The element 3 is held in a position coaxial of the casing 1 by the ridges 2 of the casing 1. There are thus provided a number, eight as shown in FIG. 2, of ducts 5, each of which is bounded by the peripheral surface of the element 3, the casing 1 and two adjacent ridges 2. The ducts 5 provide smoke flow passage means. As may be seen in FIG. 1, at the mouth end of the filter, to the right as viewing that figure, the wall of the casing 1 is inturned, the inturned portion, which is designated 6, extending into contact with the element 3. In this manner the mouth end of each of the ducts 5 is closed.

When a cigarette incorporating the filter of FIGS. 1 and 2 is smoked, initially a major proportion of the tobacco smoke entering the filter flows along the ducts 5 to the closed mouth end thereof. The smoke then flows through a very short path in the element 3 so as to exit the mouth end of the element 3 just radially inwards of the inturned portion 6 of the casing 1. Because the path length through the element 3 is short, the smoke is subjected to very little filtration by the filtration material of the element 3. However, as smoking continues a zone of the periphery of the element 3 immediately adjacent the inturned portion 6 of the casing 1 becomes blocked by deposition thereat of particulate material of the smoke. The smoke now passes into the element 3 from the duct 5 at the upstream end of the blocked zone and thus the path of the smoke through the element 3 is lengthened and the degree of filtration to which smoke is subjected is thereby increased. At each puff the width of the blocked zone at the periphery of the element 3 increases upon the deposition of further particulate matter. Thus the length of the path which the smoke traverses within the element 3, and the degree of filtration to which the smoke is subjected, gradually increases throughout the smoking of the cigarette. For this reason, the sharply increasing delivery of smoke components exhibited by a cigarette comprising a conventional filter is avoided.

The filters depicted in FIGS. 2 to 8 serve to provide a similar progressive increase in filtration efficiency, as will become clear from a reading of the descriptions thereof now following.

Figure 3:
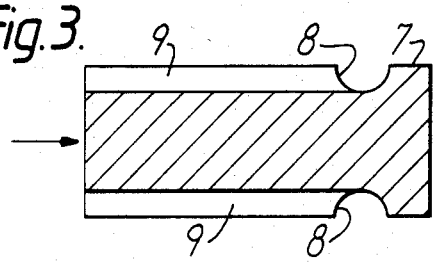
Figure 4:
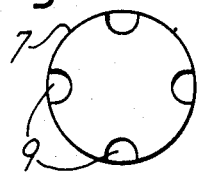
FIGS. 4 and 6 show end views, looking in the direction of the arrows, of the filters of FIGS. 3 and 5 respectively.

The cigarette filter of FIGS. 3 and 4 comprises a generally cyindrical, self-sustaining element 7 of tobacco smoke filtration material. Extending around the element 7 at a location close to the mouth end thereof is a groove 8. The groove 8 may be readily formed by a thermal moulding process if, as will generally be the case, the filtration material of the element 7 is of a thermoplastic character. The surface of the groove 8 is impervious, or substantially impervious, to smoke passage therethrough. The surface of the groove 8 may be rendered impervious as a result of a thermal moulding process of formation or by the application thereto of a sealant material, suitably a hot melt material, polyethylene for example.

Extending from the upstream end of the element 7 and opening into the groove 8 are a number, four as shown, of peripheral grooves 9 providing smoke flow passage means. The surfaces of the grooves 9 are smoke pervious.

The filter element 7 may be incorporated in known manner in a cigarette by attaching the element 7 to a cigarette rod by means of a tipping wrapper which enwraps the element 7 over the full length thereof. When such a cigarette is smoked, the degree of filtration to which the smoke is subjected gradually increases in accordance with a mechanism similar to that above described in relation to the filter of FIGS. 1 and 2. The smoke passes preferentially along the grooves 9, but smoke entering the annular groove 8 from the grooves 9 cannot pass, or readily pass, therefrom into the interior of the element 7 because, of course, the surface of the groove 8 is, at least substantially, smoke impervious. Smoke can, and does, pass into the element 7 through the smoke pervious surfaces of the grooves 9. Initially, smoke passes into the element 7 from the grooves 9 immediately upstream of the groove 8. However, as blocking of the surfaces of the grooves 9 by smoke particulate matter is established and the zones of blocking gradually extend from the downstream ends of the grooves 9, the entry locations of the smoke into the element 7 also become increasingly spaced from the downstream ends of the grooves 9 and the paths of the smoke flow to the mouth end of the element 7 become longer.

Figure 5:
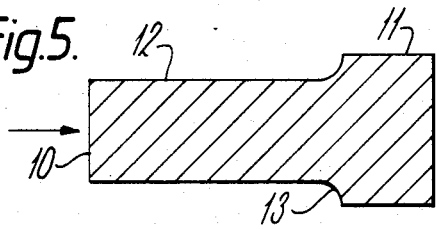
Figure 6:
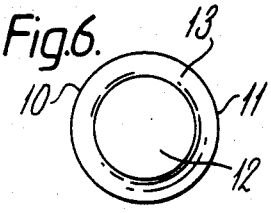

The cigarette filter of FIGS. 5 and 6 is similar to the just described filter, although instead of the smoke flow passage means being provided by a number of peripheral grooves, it is provided in the form of a single duct of annular cross-section, as will now be described. The filter of FIGS. 5 and 6 comprises a generally cylindrical, self-sustaining element 10, a first portion 11 of which is of full diameter and extends from the mouth end of the element 10 for a minor proportion of the overall length of the element 10. A second portion 12 of the element 10, which extends over the remaining length of the element 10, is of reduced diameter. A radiused shoulder 13 at the juncture of the portions 11 and 12 is rendered at least substantially smoke impervious by, for example, the application thereto of a sealant material.

The filter element 10 may be incorporated in a cigarette by attaching the element 10 to a cigarette rod, which rod is of substantially the same diameter as the portion 11 of the elemeent 10, by means of a tipping wrapper of stiff paper or paper-like material. The tipping wrapper enwraps the element 10 over the full length thereof. There is thus defined by the peripheral surface of the portion 12 of the element 10 and the tipping wrapper the above referred to annular cross-section duct. When the cigarette is smoked, tobacco smoke passing preferentially along the duct is prevented from substantial flow through the shoulder 13 by virtue of the shoulder having been rendered at least substantially smoke impervious. Thus initially smoke enters the element 10 from the duct at a location immediately upstream of the shoulder 13. As progressively extensive blocking of the peripheral surface of the portion 12 of the element 10 occurs, the path length of smoke flow within the element 10 from the duct to the mouth end of the element 10 increases.

As an alternative to the incorporation of the element 10 in a cigarette by means of a stiff tipping wrapper which, together with portion 12, defines the annular duct, the element 10 may first be inserted in a rigid casing similar to the casing 1 of FIGS. 1 and 2. The annular duct is then bounded by the wall of the casing.

Figure 7:
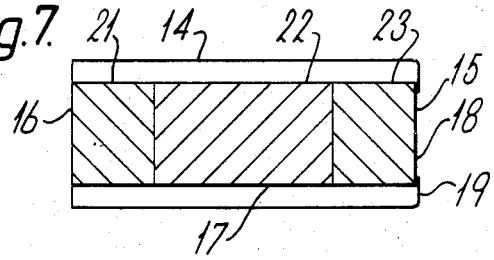
FIG. 7 shows, in axial section, another form of cigarette filter.

The cigarette filter shown in FIG. 7 is similar to the filter of FIGS. 1 and 2 and comprises a rigid, tubular casing 14 within which is disposed a cylindrical filter element 15. The element 15 is of a diameter less than that of the casing 14 and is comprised of a first, upstream portion 16, an intermediate portion 17 and a downstream portion 18. The casing 1 may be provided with ridges, similar to the ridges 2 of FIG. 2, for the purpose of holding the element 15 in a position coaxial of the casing 14. At the mouth end of the casing 14 the wall thereof is inturned, the inturned portion, which is designated 19, extending into contact with the portion 18 of the element 15.

The portions 16 and 17 are each of comparatively high pressure drop value and the portion 18 is of comparatively low pressure drop value. The portions 16 and 18 are enwrapped in smoke pervious plugwraps designated 21 and 22 respectively, whereas the portion 17 is enwrapped in a smoke impervious plugwrap 23.

When a cigarette incorporating the filter of FIG. 7 is smoked, in the early stages of the smoking a major proportion of the smoke passes into and along the space between the casing 14 and the element 15 before entering the portion 18 of the element 15. As the plugwrap 23 becomes progressively blocked by smoke particulate matter, an increasing proportion of the smoke passes through the plugwrap 21 and then flows through portions 16–18 of the element 15. Thus as smoking proceeds, the smoke is subjected to an increasing degree of filtration.

Figure 8:
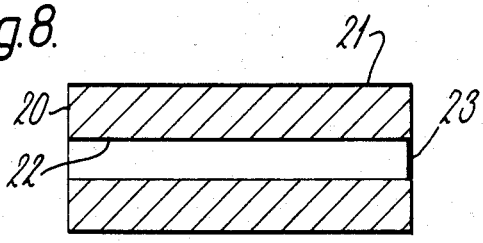
FIG. 8 shows, in axial section, a yet further form of cigarette filter.

The cigarette filter of FIG. 8 comprises a cylindrical element 20 of tobacco smoke filtration material and, at the peripheral surface of the element 20, a smoke impervious layer 21. The layer 21 may be a wrapping of web material or a casing of plastics material. Extending through the element 20 is a bore 22 providing smoke flow passage means. The upstream end of the bore 22 is open, but at the mouth end of the element 20 the bore 22 is closed by a closure member 23 which is at least substantially impervious to smoke.

When a cigarette incorporating the filter of FIG. 8 is smoked, a major proportion of the smoke passes into and along the bore 22. At the mouth end of the bore 22 smoke enters the body of the element 20 and then exits the element 20 at the mouth end face thereof. As smoking proceeds, the wall of the bore 22 becomes blocked in a zone which progressively extends further from the closure member 23 and thus the path length of smoke flow within the element 20 increases. As the path length increases, there is a concomitant increase in the degree of filtration to which the smoke is subjected.

It may be observed of the filter of FIG. 8 that the circumference of the bore 22 is considerably less than that of the element 3 of the filter of FIGS. 1 and 2. Thus for equal amounts of particulate material deposited per unit time, and equal areas of blocking, the dimension of the blocked zone in the axial direction of the filter of FIG. 8 will be greater than the corresponding dimension of the filter of FIGS. 1 and 2. This means that for the filter of FIG. 8 the degree of filtration increases faster than is the case for the filter of FIGS. 1 and 2.

What is claimed is:

1. A tobacco smoke filter comprising a body of smoke filtration material, said body of smoke filtration material being enclosed by substantially smoke impervious casing means, a smoke flowing downstream end of said body being open for smoke flow therethrough, smoke flow passage means of smoke flow impedance less than that of said body, and a smoke blockable surface bounding said body and said passage means, said passage means being located within said casing means, the downstream end of said passage means being at least substantially closed to smoke flow and said passage means being in smoke flow communication with said body through said smoke blockable surface at least at a region of said passage means extending from the downstream end thereof.

2. A filter according to claim 1, wherein said body is of generally cylindrical form.

3. A filter according to claim 1 or 2, wherein said passage means extends outside said body and is bounded by the smoke blockable surface and by said casing means.

4. A filter according to claim 3, wherein said smoke blockage surface is provided by porous plugwrap.

5. A filter according to claim 1 or 2, wherein said passage means extends within said body, and is bounded by said smoke blockable surface.

6. A filter according to claim 1, wherein said passage means is in smoke flow communication with said body at a second region, spaced longitudinally of said body from the first mentioned region, and is not, or substantially not, in smoke flow communication with said body intermediate the said first mentioned region and the said second region.

7. A filter according to claim 1 in combination with a cigarette.

* * * * *

UNITED STATES PATENT AND TRADEMARK OFFICE

CERTIFICATE OF CORRECTION

PATENT NO. : 4,660,579

DATED : April 28, 1987

INVENTOR(S) : Henry G. Horsewell et al

It is certified that error appears in the above-identified patent and that said Letters Patent is hereby corrected as shown below:

Col. 2, line 10; - "eleent" should read -- element -- .

Col. 3, line 24; - "cyindrical" should read -- cylindrical -- .

Col. 4, line 18; - "elemeent" should read -- element -- .

Signed and Sealed this

Seventeenth Day of May, 1988

*Attest:*

DONALD J. QUIGG

*Attesting Officer*

*Commissioner of Patents and Trademarks*